US005497641A

United States Patent [19]

Linde et al.

[11] Patent Number: 5,497,641

[45] Date of Patent: Mar. 12, 1996

[54] DOOR LOCK FOR MOTOR VEHICLES

[75] Inventors: Hansjürgen Linde, Coburg; Peter Wolf, Götting; Günter Seeser, München; Manfred Wimmer, Königsbrunn; Walter Weishaupt, München; Martin Wegge, München; Siegmund Schüch, München; Horst Schackmann, Wetzlar; Franz Bauer, Gröbenzell; Michael Eckrich, München, all of Germany

[73] Assignee: Bayerische Motoren Werke AG, Munich, Germany

[21] Appl. No.: 112,300

[22] Filed: Aug. 25, 1993

[30] Foreign Application Priority Data

Aug. 25, 1992 [DE] Germany ..... 42 28 234.9

[51] Int. Cl.[6] ..... E05B 65/20

[52] U.S. Cl. ..... 70/257; 70/264; 70/277; 180/289; 307/10.1; 340/825.31

[58] Field of Search ..... 70/279, 257, 256, 70/264, 277; 180/281, 289; 340/825.31; 307/10.1, 66

[56] References Cited

U.S. PATENT DOCUMENTS

| | | | |
|---|---|---|---|
| 3,733,861 | 5/1973 | Lester | 70/153 |
| 3,747,379 | 7/1973 | Cabanes | 70/280 X |
| 3,848,695 | 11/1974 | Lacaze, Jr. | 280/735 |
| 4,372,419 | 2/1983 | Barnett et al. | 70/279 X |
| 4,457,148 | 7/1984 | Johansson et al. | 70/278 |
| 4,866,963 | 9/1989 | Leininger et al. | 70/256 X |
| 4,895,009 | 1/1990 | Kleefeldt et al. | 70/256 X |
| 4,907,429 | 3/1990 | Davis et al. | 70/279 |
| 4,940,964 | 7/1990 | Dao | 340/438 |
| 5,061,923 | 10/1991 | Miller et al. | 70/278 X |
| 5,072,973 | 12/1991 | Gudgel et al. | 292/278 X |
| 5,265,452 | 11/1993 | Dawson et al. | 70/278 |

FOREIGN PATENT DOCUMENTS

| | | | |
|---|---|---|---|
| 2678018 | 12/1992 | France . | |
| 0310074 | 12/1989 | Japan | 70/277 |
| 4331648 | 11/1992 | Japan . | |

*Primary Examiner*—Lloyd A. Gall

*Attorney, Agent, or Firm*—Evenson, McKeown, Edwards & Lenahan

[57] ABSTRACT

A door lock for motor vehicles having a control element which is driven by an electric motor, is controlled by an electronic control unit and can be moved, upon a control signal emitted by a transmitter, into a position which at least prepares the opening of the door lock. An energy accumulator, which is independent of the wiring of the motor vehicle and which, as required, can be connected to a signal receiver, is assigned to the electronic control system so that the signal receiver will then activate the control element directly.

9 Claims, 1 Drawing Sheet

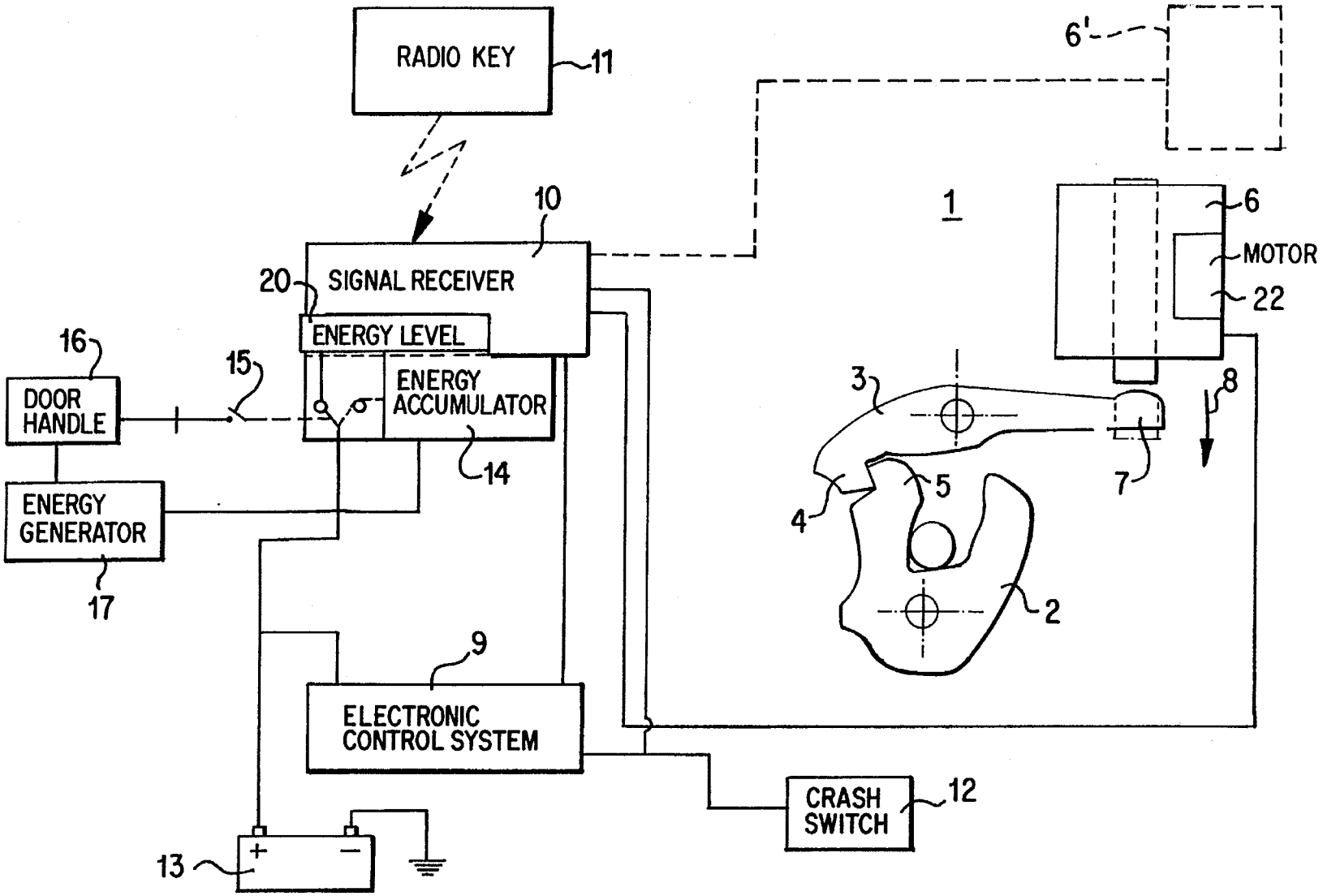
MOTOR
6
22
8
7
6'
1
2
5
3
4
12
CRASH SWITCH
11
RADIO KEY
10
SIGNAL RECEIVER
ENERGY LEVEL
ENERGY ACCUMULATOR
14
9
ELECTRONIC CONTROL SYSTEM
20
15
13
16
DOOR HANDLE
ENERGY GENERATOR
17

DOOR LOCK FOR MOTOR VEHICLES

BACKGROUND AND SUMMARY OF THE INVENTION

The present invention relates to a door lock for motor vehicles having a control element which is driven by an electric motor, is controlled by an electronic control unit and can be moved, upon a control signal emitted by a transmitter, into a position which at least prepares the opening of the door lock.

Door locks of this general type are known. The transmitter, which is also called a "radio key", as a rule, supplies a signal which is transmitted in a wireless manner by the signal receiver to the electronic control system and operates, for example, on the basis of electromagnetic waves. When the elect:conic control system receives a corresponding signal from a pertaining radio key, the control element can unlock the door lock or move it into a predetent position from which the door lock can then be opened, for example, by means of the conventional door handle.

Door locks of this type are very user friendly. However, as a rule, they have a specific disadvantage. Their method of operation is a function of the operability of the wiring by which the control element or the electronic control system is supplied with energy. In the case of an accident or in the case of a defect of the wiring, however, a condition may occur in which the proper functioning of the electronic control system or of the control element is no longer ensured. Although it is known in this connection to provide a mechanical emergency measure for such a case, in which the door lock can be unlocked purely mechanically without any electrical or electromagnetic remedial measures, considerable mechanical expenditures must be provided in this case which cancel the advantage gained in user friendliness in such a lock by the costs, the weight and also to the operability.

It is an object of the invention to provide a door lock of the initially mentioned type which retains the mentioned advantages with low additional expenditures and which is also operable as required or in a case of emergency.

This and other objects are achieved by the present invention which provides a door lock for motor vehicles comprising a control element which is drivable by an electric motor, an electronic control system coupled to the control element to control the control element, the control element being movable into a position which at least prepares the opening of the door lock in response to a control signal, and an energy accumulator assigned to the electronic control system and is independent of wiring of the motor vehicle, the energy accumulator being connectable to the signal receiver if required such that the signal receiver will activate the control element directly.

By the provision of the self-sufficient energy accumulator, it becomes possible to operate the control element in the event of a failure of the wiring or of the electronic control system. As a rule, operability is also ensured in the event of an accident because the connecting paths between the energy accumulator, the signal receiver and the control element may be designed to be short, and the risk of damage to the unit comprising these three elements can therefore be reduced considerably. On the other hand, the characteristic of not connecting the energy accumulator to the signal receiver before it is required, provides that under normal operating conditions, i.e., when the wiring is operable, the energy accumulator is not used and is therefore available to an unlimited degree when it is required.

Certain embodiments of the invention permit an even more pronounced independence of the unit comprising the energy accumulator, the control element and the signal receiver from the condition of the wiring, because the condition in which the energy supply by the wiring no longer meets a minimum requirement is recognized by the signal receiver itself such as through an energy level detector 20 and, as a rule, the energy accumulator is activated automatically. The alternative case, in which the signal receiver can be manually connected to the energy accumulator, as a rule, requires higher expenditures because the minimum requirement must then, for example, be determined by the electronic control system in that the control element is not operable.

In certain embodiments of the invention, the energy accumulator is activatable by a switch coupled with the door handle, thereby providing a simple possibility of activating the energy accumulator as required. In this case, it is a special advantage that the failure of the wiring does not become noticeable to the user in a particularly negative manner, and the activating of the energy accumulator takes place in a manner that is self-evident and virtually "natural" for the user of the vehicle. After emitting an opening signal by means of the radio key, the user will attempt to unlock the door lock as usual. If the wiring is incapable of serving the control element, the vehicle user can, as a rule, recognize the sequence interference. He will then attempt to open the door in the customary manner by means of the door handle. This activates the energy accumulator. The door lock can then be unlocked by the vehicle user. He may, for example, again trigger an opening signal by means of the radio key and thus move by means of the signal receiver, the control element into the opening direction. Naturally, it is also possible to mechanically open the door lock so long as a mechanical connection is provided between the door handle and the door lock by way of the control element activated by the signal receiver and the energy accumulator.

A complement or an alternative to a self-sufficient energy accumulator is provided by certain embodiments that include an energy accumulator which can be moved by means of the door handle, for example, in the manner of a dynamo. As in the case of a static energy accumulator, also in this case, the energy generator may be capable of being activated only when required.

Certain embodiments provide a possibility for utilizing the energy accumulator for at least one other door lock. For this purpose, an electrical connection need only be provided between the energy accumulator, the pertaining signal receiver and the control element of the second door lock. By means of an energy accumulator, it is therefore possible to electrically open at least two doors independently of the other wiring.

Other objects, advantages and novel features of the present invention will become apparent from the following detailed description of the invention when considered in conjunction with the accompanying drawings.

BRIEF DESCRIPTION OF THE DRAWINGS

The single FIGURE is a schematic: view of a door lock constructed in accordance with an embodiment of the present invention which can be opened electrically in the event of a failure of the wiring.

DETAILED DESCRIPTION OF THE DRAWINGS

A door lock of a motor vehicle is schematically illustrated as a lock latch 2 and a locking lever 3. In the locked condition, a nose 4 of the locking lever 3 reaches behind a projection 5 of the lock latch 2. For the unlocking of the door lock 1, a control element 6 is provided which can be moved by an electric motor 22 and which acts upon an extension arm 7 of the locking lever 3. This extension arm 7, if necessary, is moved into a direction which is indicated by means of arrow 8 in the figure. In this case, the nose 4 is disengaged from the projection 5. The door, which is not shown in detail, may then be opened.

Normally, the control element 6 is controlled by an electronic control system 9 which is, for example, also arranged in the door and which interacts with a signal receiver 10. The signal receiver 10 receives code signals which are transmitted in a wireless manner and which are emitted by a schematically illustrated radio key 11. When the signal receiver receives a code signal of the pertaining radio key, the electronic control system 9 is activated, and the control element 6 is moved in the direction of arrow 8. In the event of a serious accident, the electronic control system 9 may also be activated automatically by a crash switch 12 instead of a code signal emitted by the radio key 11 for operating the control element 6.

The above-described sequence will be active as long as the wiring of the motor vehicle is intact; that is, provides a sufficient energy supply for the electronic control system 9 and the control element 6. The wiring is supplied with energy by a schematically illustrated wiring battery 13. When connection of the wiring battery 13 to the electronic control system 9 is interrupted or the connection between the signal receiver 10 and the electronic control system 9 is interrupted or the wiring battery 13 is discharged, the control element 6 can no longer be supplied with energy from the wiring battery 13. For these circumstances, a separate energy accumulator 14 is provided which is integrated, for example, in the signal receiver 10. The energy accumulator 14 can be connected with the signal receiver 10 by a switch 15. Such a connection will, for example, automatically occur when a threshold value switch (not shown) provided in the signal receiver 10 determines an interruption of the energy supply by the wiring battery 13, or a falling below a given wiring voltage value or energy level. As an alternative, the switch 15 in this case can also be coupled with a schematically indicated door handle 16, so as to manually, as opposed to the use of the radio key 11 connect the energy accumulator 14 with the signal receiver 10 only when the door handle 16 is operated.

The energy accumulator 14 can be charged by an energy generator 17 that is coupled with the door handle 16. The door handle 16 is adjustable into an energy generating mode only as required.

The energy accumulator 14 can supply, as required, the control element 6' of another door lock with energy.

If required, the energy accumulator 14 will be connected with the signal receiver 10. The signal receiver 10 will then operate self-sufficiently and, if required, permits the controlling of the control element 6 independently of the electronic control system 9 and the opening of the door lock 1.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. In a motor vehicle having wiring and at least one locking element, a door lock comprising:

a control element for operating the locking element;

an electric motor for driving the control element;

a transmitter for emitting a control signal;

a signal receiver for receiving the control signal and being coupled to the control element;

an electronic control system coupled via the wiring of the motor vehicle to the signal receiver and an exterior energy supply to control the control element, the control element being movable into a position which prepares the opening of the locking element, in response to the control signal;

an energy accumulator assigned to the electronic control system, said energy accumulator being directly connectable to the signal receiver independent of the wiring of the motor between the signal receiver, exterior energy supply and electronic control system; and wherein the energy accumulator is connectable to the signal receiver to allow the signal receiver to activate the control element without said exterior energy supply.

2. A motor vehicle door lock according to claim 1, wherein the signal receiver, includes means for recognizing when energy supply by the wiring is below a minimum requirement.

3. A motor vehicle door lock according to claim 2, further comprising a switch which is coupled with a door handle and the energy accumulator, the energy accumulator being activatable by the switch.

4. A motor vehicle door lock according to claim 3, further comprising an energy generator coupled to the energy accumulator and the door handle, wherein the energy accumulator is chargeable by the energy generator.

5. A motor vehicle door lock according to claim 4, wherein the door handle is adjustable into an energy generating mode.

6. A motor vehicle door lock according to claim 1, wherein the energy accumulator supplies energy to activate the control element of at least one other locking element.

7. A motor vehicle door lock according to claim 1, further comprising a switch which is coupled with a door handle and the energy accumulator, the energy accumulator being activatable by the switch.

8. A motor vehicle door lock according to claim 1, further comprising an energy generator coupled to the energy accumulator and a door handle, wherein the energy accumulator is chargeable by the energy generator.

9. A motor vehicle door lock according to claim 8, wherein the door handle is adjustable into an energy generating mode.

* * * * *